US007918521B2

(12) United States Patent
Furuya et al.

(10) Patent No.: US 7,918,521 B2
(45) Date of Patent: Apr. 5, 2011

(54) DROPLET EJECTING APPARATUS

(75) Inventors: Masami Furuya, Kanagawa (JP); Kenichi Kawauchi, Kanagawa (JP); Susumu Kibayashi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 974 days.

(21) Appl. No.: 11/810,025

(22) Filed: Jun. 4, 2007

(65) Prior Publication Data

US 2008/0100655 A1 May 1, 2008

(30) Foreign Application Priority Data

Oct. 31, 2006 (JP) ..... 2006-296170

(51) Int. Cl.
*B41J 29/38* (2006.01)

(52) U.S. Cl. ..... 347/10; 347/5; 347/6; 347/7; 347/8; 347/9; 347/11; 347/12; 347/13; 347/14; 347/15; 347/16; 347/17; 347/18; 347/19

(58) Field of Classification Search ..... 347/5–19
See application file for complete search history.

(56) References Cited

U.S. PATENT DOCUMENTS

| | | | | |
|---|---|---|---|---|
| 6,053,595 | A * | 4/2000 | Otsuka et al. | 347/9 |
| 6,390,588 | B1 * | 5/2002 | Ikeda | 347/19 |
| 6,783,201 | B2 * | 8/2004 | Ninomiya | 347/8 |
| 7,344,217 | B2 * | 3/2008 | Kitamura et al. | 347/15 |
| 7,726,765 | B2 * | 6/2010 | Yoshida et al. | 347/19 |

FOREIGN PATENT DOCUMENTS

| | | |
|---|---|---|
| JP | 2003-48352 | 2/2003 |
| JP | 2005-305919 | 11/2005 |

* cited by examiner

*Primary Examiner* — Ryan Lepisto
*Assistant Examiner* — Guy G Anderson
(74) *Attorney, Agent, or Firm* — Fildes & Outland, P.C.

(57) ABSTRACT

In a droplet ejecting apparatus, a detection pattern output unit drives a droplet ejecting head based on a pulse signal and image information of a detection pattern comprising plural unit patterns so as to form an image of the detection pattern on a recording medium. A correction information generating unit derives a distance between adjacent unit patterns based on the image of a read detection pattern, compares the distance with a distance according to the conveyance velocity of the recording medium by a moving unit, and generates correction information so as to enlarge the pulse width when the derived distance is shorter, and to reduce the pulse width when the derived distance is longer.

20 Claims, 14 Drawing Sheets

DROPLET EJECTING APPARATUS

CROSS-REFERENCE TO RELATED APPLICATIONS

This application is based on and claims priority under 35 USC 119 from Japanese Patent Application No. 2006-296170 filed Oct. 31, 2006.

BACKGROUND OF THE INVENTION

1. Technical Field

The present invention relates to a droplet ejecting apparatus.

2. Related Art

The droplet ejecting apparatus such as an ink jet printer forms an image by driving a recording head according to image data and ejecting ink droplets onto a recording medium from nozzles of the recording head.

In some recording head adopting full width array (FWA) technology in which plural nozzles are arranged on scanning lines throughout the entire width of the recording medium, for example, a cord wheel is attached on a rotation shaft of a drive roll for conveying the recording medium and a signal obtained by reading a mark on the cord wheel by an optical sensor is used for droplet ejection timing control.

The drive roll contains eccentric error due to manufacturing reason. The cord wheel also contains installation error and a print error of the mark thereon.

For the reason, cyclic mismatch is generated between an encoder signal for use in print clock and conveyance velocity of the recording medium so that the ejection timing deviates, thereby causing a deviation in a droplet shot position on a paper.

SUMMARY

In consideration of the above circumstances, the present invention provides a droplet ejecting apparatus.

According to an aspect of the invention, there is provided a droplet ejecting apparatus comprising: a droplet ejecting head for ejecting droplets onto a recording medium; a moving unit for moving the recording medium relative to the droplet ejecting head; an output unit for outputting a pulse signal which is generated along with moving of the moving unit and which has a pulse width comprising a cyclic fluctuation; a reference position detection unit for detecting a reference position in the cyclic fluctuation; a pattern memory for storing image information of a detection pattern comprising plural unit patterns which are set in advance; a reading unit for reading an image formed on the recording medium; a detection pattern output unit that drives the droplet ejecting head based on the pulse signal outputted from the output unit and the image information of the detection pattern stored in the pattern memory when a detection pattern output instruction is present; a correction information generating unit that makes the reading unit read an image on the recording medium on which the detection pattern image is formed by the detection pattern output unit, derives a distance between the unit patterns adjacent each other based on the image read by the reading unit, compares the distance with a distance according to a conveyance velocity of the recording medium by the moving unit; and generates correction information so as to enlarge the pulse width when the derived distance is shorter than the distance according to the conveyance velocity, and to reduce the pulse width when the derived distance is longer than the distance according to the conveyance velocity; a memory that stores the correction information generated by the correction information generating unit; a correction unit for correcting the pulse width of the pulse signal outputted from the output unit based on a detection timing of the reference position by the reference position detection unit and the correction information stored in the memory; and a head controller for forming an image according to image information on the recording medium by controlling the droplet ejecting timing of the droplet ejection head using the pulse signal corrected by the correction unit.

BRIEF DESCRIPTION OF THE DRAWINGS

Exemplary embodiments of the present invention will be described in detail based on the following figures, wherein.

DETAILED DESCRIPTION

Hereinafter, the exemplary embodiments of the present invention will be described with reference to the accompanying drawings.

First Exemplary Embodiment

Figure 1:
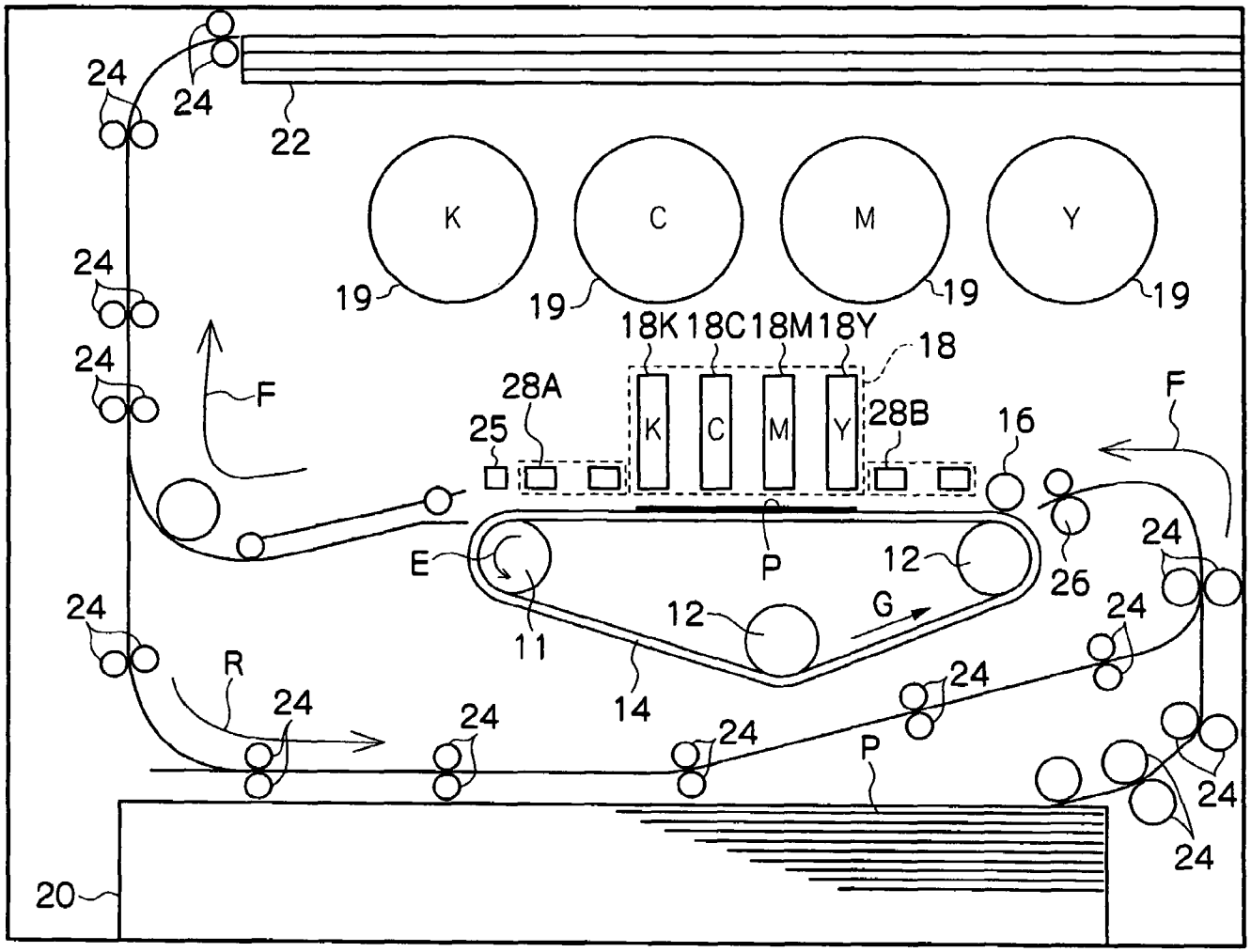
FIG. 1 is a schematic view showing the structure of an image forming apparatus according to a first exemplary embodiment.

FIG. 1 schematically shows the structure of the image forming apparatus 10 according to the exemplary embodiment of the invention. As shown in the FIG. 1, the image forming apparatus 10 includes a paper feed tray 20, an exit tray 22 and plural rollers 24.

Recording papers P are accommodated in the paper feed tray 20. When an image is formed, the recording papers P are picked up one by one from the paper feed tray 20 by the rollers 24, and conveyed along a predetermined conveyance passage F within the image forming apparatus 10 and ejected into the exit tray 22.

A conveyance belt 14 and a adherence unit 16 are disposed along the conveyance passage F of this recording paper P. The conveyance belt 14 is stretched around a drive roll 11 which rotates in the direction of an arrow E and two driven rolls 12 which rotate following the rotation of the drive roll 11, and the conveyance belt 14 rotates in the direction of an arrow G. The adherence unit 16 presses the recording paper P conveyed on the conveyance passage F against the conveyance belt 14 and applies electric charge to the recording paper P so as to adhere the recording paper P electrostatically to the conveyance belt 14.

A registration roller 26 is disposed on the upstream side of the conveyance belt 14 of the conveyance passage F of the recording paper P. The registration roll 26 carries out a paper skew correction in order to prevent the recording paper P conveyed along the conveyance passage F from being adhered in a state in which it is skewed with respect to the conveyance direction.

A recording head array 18 constructed of four recording heads 18Y, 18M, 18C, 18K which eject four color inks, yellow (Y), magenta (M), cyan (C) and black (K) are provided at positions opposing a recording face of the recording paper P adhered electrostatically to the conveyance belt 14 in the conveyance passage F of the recording paper P.

In each of the recording heads 18Y, 18M, 18C, 18K for the respective colors, a head unit having plural ejection nozzles is arranged over the entire width of the conveyance belt 14. This structure is of full width array (FWA) type, constituted of plural ejection nozzles.

While a member provided for each color is expressed with an alphabet (Y/M/C/K) indicating each color, at the end of the reference numeral, this alphabet at the end of the reference numeral is omitted if description is made without distinguishing colors.

As shown in FIG. 1, the image forming apparatus 10 of this exemplary embodiment includes front/rear face inversion conveyance passages R. When performing double-side printing, the recording paper P is conveyed along the conveyance passage R after an image is formed on one side when the recording paper face is inverted such that the opposite face to the face in which the image is formed opposes the respective recording heads 18Y, 18M, 18C, 18K.

Ink tanks 19 which stores inks of the respective colors are provided between the conveyance belt 14 and the exit tray 22. Ink from the ink tank 19 is supplied to the recording heads 18Y, 18M, 18C, 18K through an ink supply pipe (not shown).

Here, the recording heads 18Y, 18M, 18C, 18K are constructed to be movable apart from the conveyance belt 14 by a drive mechanism (not shown).

Maintenance devices 28A, 28B are provided on the upstream side and downstream side in the conveyance passage F of the recording heads 18Y, 18M, 18C, 18K. The maintenance device 28A includes maintenance units 30K, 30C for black and cyan and the maintenance device 28B includes maintenance units 30M, 30Y for magenta and yellow. The respective maintenance devices 28A, 28B are constructed to be movable in a direction in which both of them approach each other by a drive mechanism (not shown).

Figure 2:
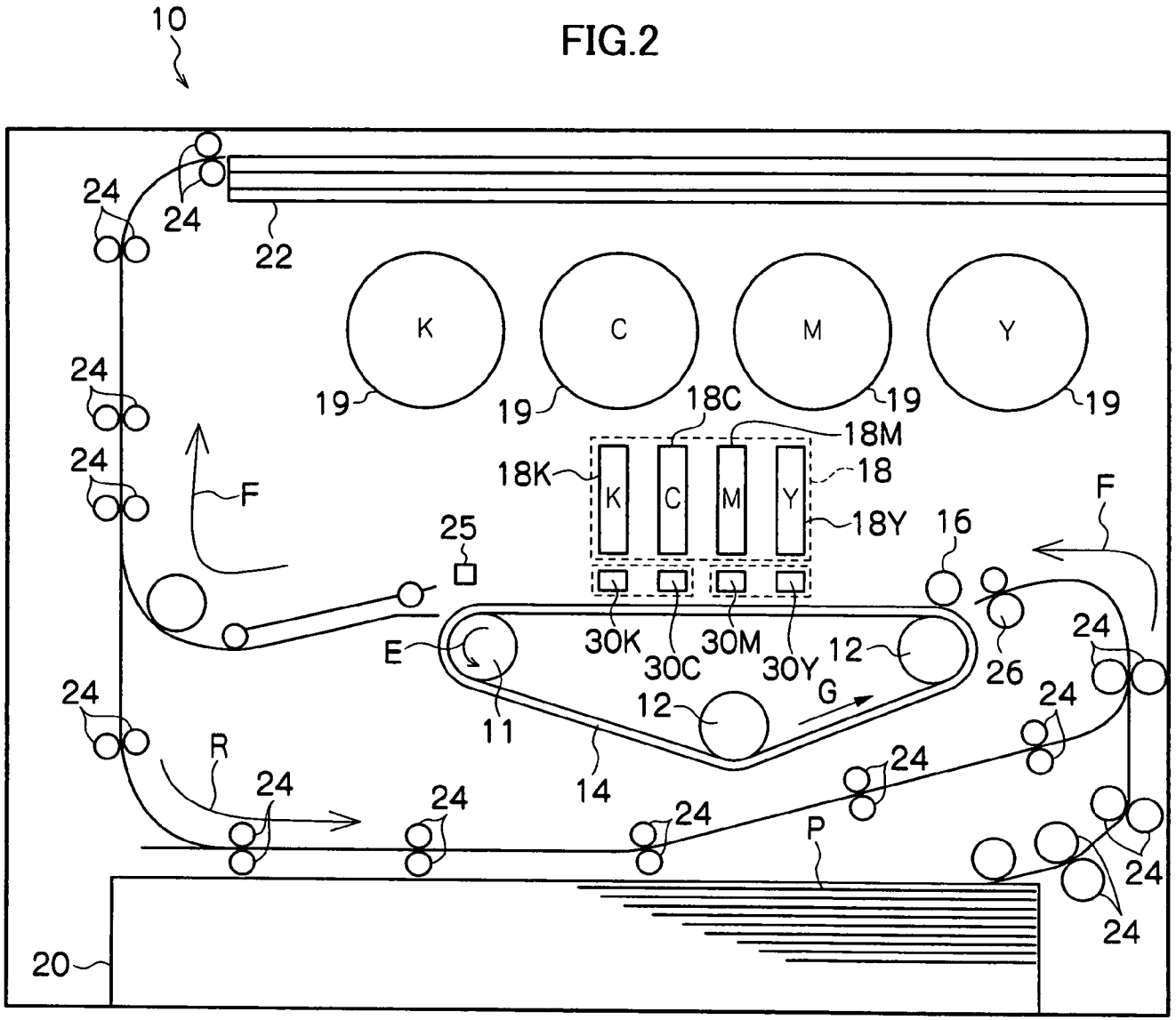
FIG. 2 is a diagram showing the positional relation between a recording head, maintenance device and conveyance belt at the time of maintenance.

As shown in FIG. 2, the recording heads 18Y, 18M, 18C, 18K are moved apart from the conveyance belt 14 at the time of maintenance. Further, the maintenance devices 28A, 28B are moved into a space between the recording heads 18Y, 18M, 18C, 18K and the conveyance belt 14 generated by moving the recording heads 18Y, 18M, 18C, 18K.

Consequently, the maintenance units 30Y, 30M, 30C, 30K of the maintenance devices 28A, 28B are disposed to oppose the four recording heads 18Y, 18M, 18C, 18K and then maintenance processing is executed appropriately by the respective maintenance units 30.

Maintenance processing to be executed by the maintenance unit 30 includes sucking of ink liquid in the nozzle, wiping of ink droplet adhering to the ejecting port of a nozzle, supply of ink liquid into the nozzle and the like.

As shown in FIGS. 1, 2, a line sensor 25 is disposed in the downstream of the recording head 18 in the conveyance passage F so that an image printed on the recording paper P may be read.

Figure 3:
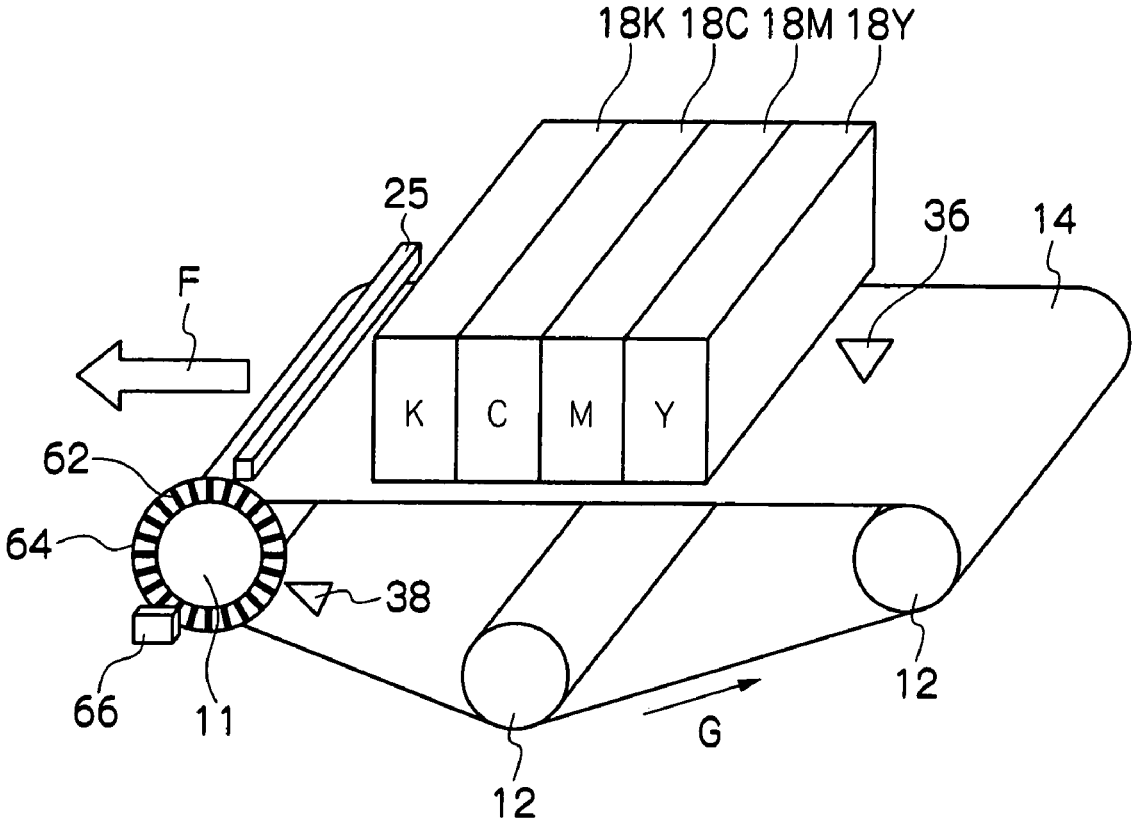
FIG. 3 is a schematic diagram showing the structure of around the recording head according to the first exemplary embodiment.

As shown in FIG. 3, a disc-shaped encoder film 64 which rotates with the drive roll 11 is attached to the rotation shaft of the drive roll 11. Print timing marks 62 are provided radiantly around the rotation shaft of the drive roll 11 on the peripheral portion of the encoder film 64.

An encoder sensor 66 is provided at a position on this peripheral portion so as to oppose the print timing marks 62. The print timing mark 62 passing a reading position is read by the encoder sensor 66. With a rotation of the drive roll 11, the print timing marks 62 of the encoder film 64 pass the reading position of the encoder sensor 66 successively.

The radiant print timing marks 62 are provided at an equal interval on design and the print timing marks 62 are read at a predetermined cycle when the drive roll 11 rotates at an equal velocity. The detection cycle of the print timing marks 62 is changed according to the rotation velocity of the drive roll 11.

As shown in FIG. 3, a reference position detection sensor 38 is provided in the vicinity of the drive roll 11. The reference position detection sensor 38 detects a reference position mark provided on the surface of the drive roll 11. The reference position mark is provided at a position of the drive roll 11 and is detected by the reference position detection sensor 38 each time when the drive roll 11 turns a single turn. The reference position detection sensor 38 outputs a detection signal which turns to high when the reference position mark is detected.

As shown in the FIG. 3, a paper front end detection sensor 36 for detecting the front end of the paper P adhered on the conveyance belt 14 is disposed on the upstream side in the conveyance direction of the recording paper P with respect to the recording head array 18. The paper front end detection sensor 36 detects presence or absence of any paper at a detection position and outputs a paper front end detection signal which is high when a paper is present and low when no paper is present. Therefore, rise timing of the paper front end detection signal indicates the detection timing of the front end of the recording paper P.

Figure 4:
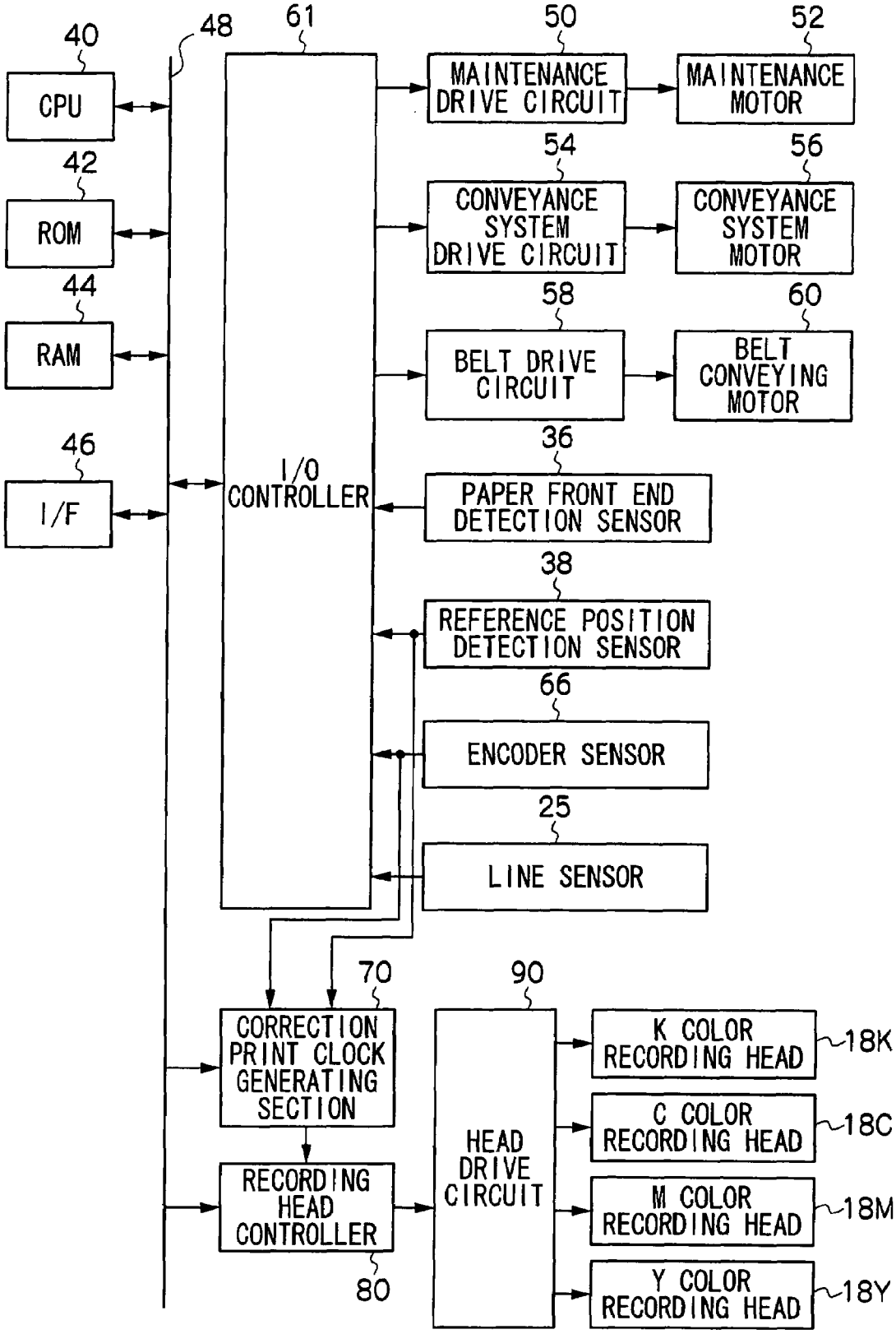
FIG. 4 is a control block diagram of this exemplary embodiment.

FIG. 4 is a block diagram showing the structure of the control system of the image forming apparatus 10 of this exemplary embodiment. As shown in FIG. 4, the image forming apparatus 10 includes a CPU 40 for controlling the entire system, ROM 42, RAM 44, interface (I/F) and the like and these components are connected to a bus 48.

The image forming apparatus 10 is connected to an upper level unit such as a computer through an I/F 46 and performs printing based on image data and the like sent from the upper level unit.

An I/O controller 61, a correction print clock generating section 70, and a recording head controller 80 are connected to the bus 48. The CPU 40 controls the I/O controller 61 and the recording head controller 80 to control printing on the recording paper P.

A maintenance drive circuit 50, a conveyance system drive circuit 54 and a belt drive circuit 58 are connected to the I/O controller 61.

A maintenance motor 52 for driving the maintenance unit 30 is connected to the maintenance drive circuit 50. When the maintenance drive circuit 50 drives the maintenance motor 52, the maintenance unit 30 cleans the recording head 18. That is, the I/O controller 61 drives each drive circuit according to an instruction of the CPU 40 so as to convey the recording paper P and clean the recording head 18.

A conveyance system motor 56 for driving each roller of passages F, R is connected to the conveyance system drive circuit 54. The conveyance system drive circuit 54 drives the conveyance system motor 56 so as to convey the recording paper P within the apparatus.

A belt conveying motor 60 for driving the drive roller 11 is connected to the belt drive roller 58. The belt drive circuit 58 drives the belt conveying motor 60 to rotate the conveyance belt 14 in order to convey the recording paper P.

The paper front end detection sensor 36, the reference position detection sensor 38 and the encoder sensor 66 are connected to the I/O controller 61 and a detection result of each sensor is inputted thereto so that printing is controlled by the CPU 40 based on a detection result of each sensor.

The correction print clock generating section 70 is connected to the recording head controller 80. The correction print clock generating section 70 corrects a clock signal based on a reading signal of the print timing mark 62 by the encoder sensor 66 based on correction information set preliminarily and outputs the obtained correction print clock to the recording head controller 80.

The recording head controller 80 is connected to the recording head 18 of each color through the head drive circuit 90. The recording head controller 80 inputs an ink droplet ejection signal based on image data into the head drive circuit 90 at a timing according to the correction print clock signal generated by the correction print clock generating section 70 so as to execute ink droplet ejection control by the recording head 18.

That is, an ink droplet is ejected synchronously with the correction print clock from the ejection nozzle of the recording head 18 so that 1-dot ink droplet is ejected per a print clock.

The CPU 40 turns ON an ejection enable signal of each of the recording heads 18Y, 18M, 18C, 18K to be inputted to the recording head controller 80 at a timing based on a detection signal of the paper front end detection sensor 36.

Figure 5:
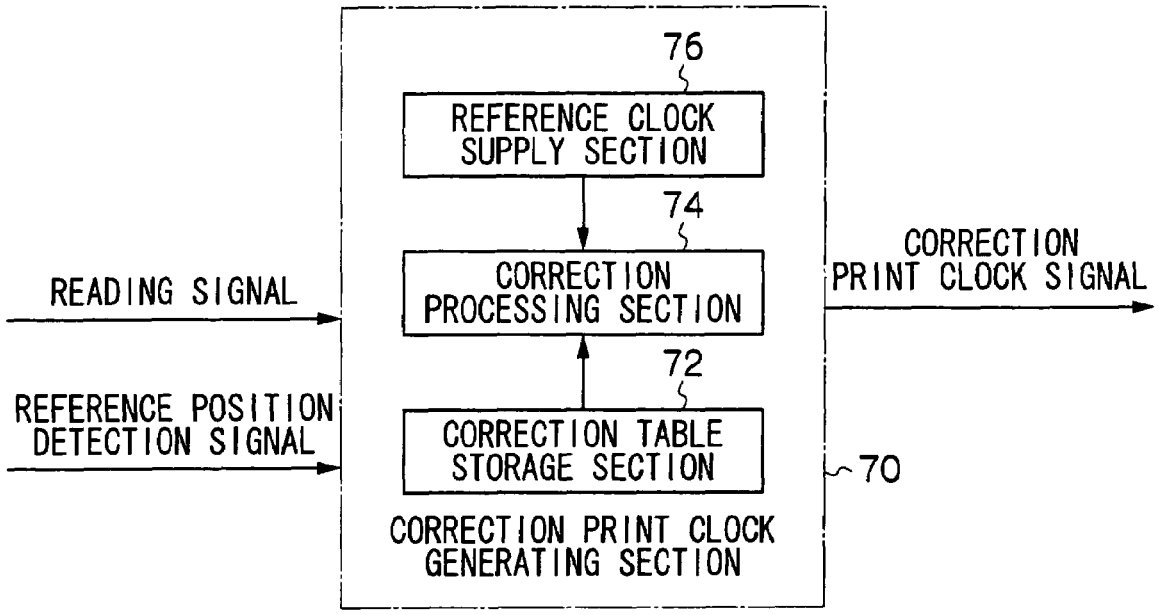
FIG. 5 is a block diagram of correction processing of print clock according to this exemplary embodiment.

FIG. 5 shows the structure of the correction print clock generating section 70 of this exemplary embodiment. As shown in FIG. 5, the correction print clock generating section 70 includes a correction table storage section 72, a correction processing section 74, and a reference clock supply section 76.

A reading signal of the print timing mark 62 by the encoder 66 and a reference position detection signal from the reference position sensor 38 are inputted to the correction print clock generating section 70. The correction print clock generating section 70 executes correction processing according to correction information stored in the correction table storage section 72 with the reference clock inputted from the reference clock supply section 76 used as an operating clock.

The CPU 40 executes creation processing of the correction information to the correction table storage section 72. In this case, the CPU 40 executes reading of image data based on information relating to deviation detection pattern A stored in the ROM 42 or the like, print of the deviation detection pattern A via the recording head controller 80, reading of an image on the recording paper P by the line sensor 25 and creation of the correction table based on image data outputted from the line sensor 25.

At this time, the CPU 40 inhibits correction of print clock by the correction print clock generating section 70. Consequently, the head drive circuit 90 is controlled based on a non-corrected print clock in the recording head controller 80.

Hereinafter the operation of this exemplary embodiment will be described.

When an upper level unit such as computer sends print data and requests print, the CPU 40 outputs the print data sent with the print request to the recording head controller 80 and controls the conveyance system drive circuit 54 through the I/O controller 61 to drive the conveyance system motor 56. Consequently, the recording paper P is conveyed from the paper tray 20 to the conveyance belt 14 through the conveyance passage F.

When the recording paper P is conveyed onto the conveyance belt 14, the front end of the recording paper P is detected by the paper front end detection sensor 36. Then, when a detection result is inputted to the CPU 40 through the I/O controller 61, the CPU 40 controls the head drive circuit 90 through the recording head controller 80 to control printing of the recording head 18.

Figure 6:
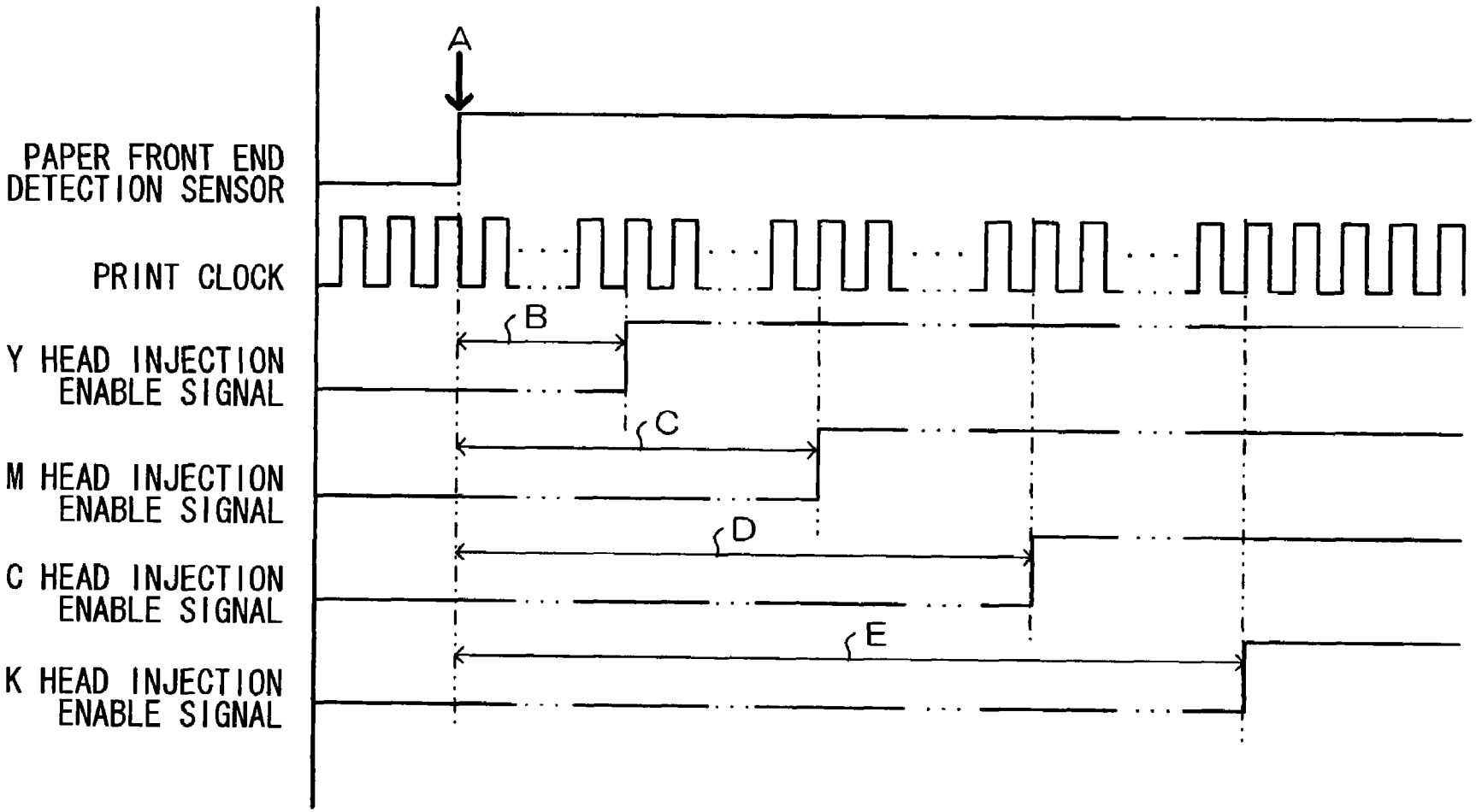
FIG. 6 is a timing chart showing the relation between conveyance timing of a recording paper, print clock and print permission timing to each recording head.

As shown in FIG. 6, ejection enable signals are turned ON successively at a timing in which the recording paper P detected by the paper front end detection sensor 36 reaches a recording position (drop position of ink ejected from the recording head 18) of each of the recording heads 18Y, 18M, 18C, 18K. Consequently, images of respective colors are superimposed on the recording paper P so as to form a color image.

Durations B to E from a timing A in which the front end of the recording paper P is detected up to a timing in which an ejection enable signal of each of the recording heads 18Y, 18M, 18C, 18K is turned ON are determined depending on a distance between a detection position of the paper front end detection sensor 36 and a recording position of each of the recording heads 18Y, 18M, 18C, 18K and conveyance velocity.

The distance between the detection position of the paper front end detection sensor 36 and the recording position of each recording head 18 may be determined with a design value or may be corrected appropriately considering manufacturing tolerance at the time of shipment from plant.

Then, the recording paper P which is printed by the recording head 18 is conveyed along the conveyance passage F and ejected to the exit tray 22.

The correction processing of the print clock used as a control timing signal for the head drive circuit 90 in the recording head controller 80 will be described.

The reading signal of the print timing mark 62 by the encoder sensor 66 and the reference position detection signal from the reference position sensor 38 are inputted to the correction print clock generating section 70. The correction print clock generating section 70 corrects this reading signal according to the correction information stored in the correction table storage section 72.

More specifically, a correction table as shown in Table 1, for example, is set preliminarily and stored in the correction table storage section 72. As shown in Table 1, the correction table is set for steps in the unit of plural clocks.

According to this exemplary embodiment, the circumferential length of the drive roll 11 is 110 mm and assuming that 5200 print clocks are outputted per a single rotation of the drive roll, the correction values are set for 50 steps (n=50). That is, 5200 clocks on a single rotation are divided to 50 steps, 104 clocks for each step.

TABLE 1

Correction Table

| Step No. | Correction Value q (nsec) |
|---|---|
| 0 | 50 |
| 1 | 50 |
| 2 | 50 |
| 3 | 50 |
| 4 | 50 |
| 5 | 75 |
| 6 | 75 |
| 7 | 75 |
| 8 | 75 |
| 9 | 50 |
| 10 | 50 |
| 11 | 50 |
| 12 | 50 |
| 13 | 50 |
| 14 | 50 |
| 15 | 25 |
| 16 | 25 |
| 17 | 25 |
| 18 | 0 |
| 19 | 0 |
| ... | ... |
| 49 | 50 |

In this exemplary embodiment, while correction of reading signal by the correction print clock generating section 70 is inhibited by the CPU 40, a deviation detection pattern A is printed for each predetermined print clock by the recording head 18. The printed deviation detection pattern A is read by the line sensor 25 and then, an interval T between the deviation detection patterns A printed at adjacent positions and a design value S of the interval of the adjacent deviation detection patterns A according to the specification of the image forming apparatus 10 are compared based on the obtained image data so as to correct the print clock according to the deviation amount Z.

Figure 7:
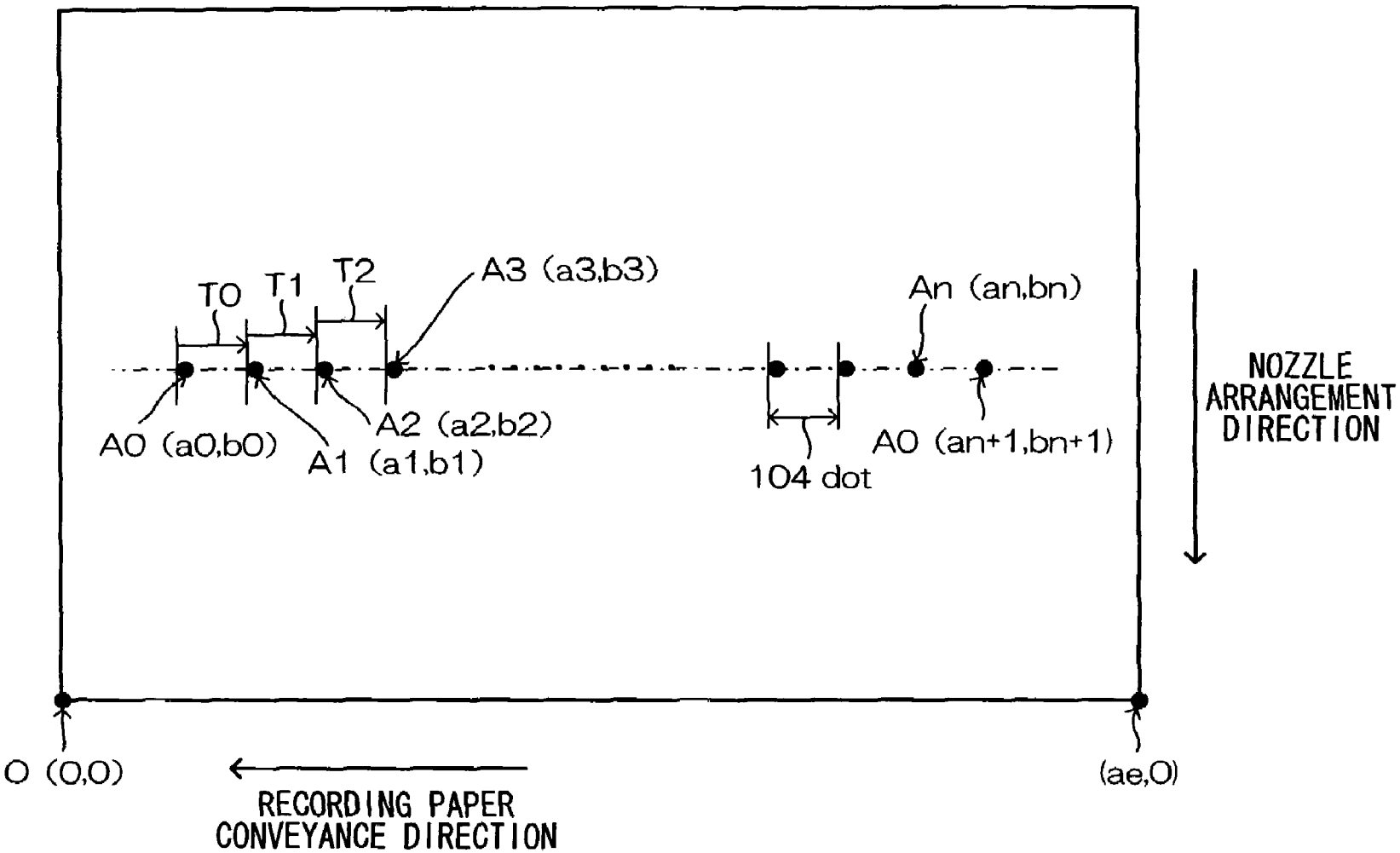
FIG. 7 is an explanatory diagram of deviation detection pattern and an derivation method of correction amount based on the deviation detection pattern.

FIG. 7 shows an example in a state in which the deviation detection pattern A is printed on the recording paper P at each predetermined print clock. In the example indicated in FIG. 7, the deviation detection pattern A is an ink droplet of a dot and the deviation detection pattern A is printed every 104 dots (equal to a step).

That is, the CPU 40 inputs image data based on information concerning the deviation detection pattern A stored in the ROM 42 preliminarily into the recording head controller 80. Further, the CPU 40 starts printing of the deviation detection pattern A at a timing in which the reference position detection signal outputted from the reference position detection sensor 38 turns to HIGH. At this time, correction of the print clock by the correction print clock generating section 70 is inhibited. Consequently, the head drive circuit 90 is controlled by the recording head controller 80 based on a non-corrected print clock.

When start of printing is instructed by the CPU 40, the recording head controller 80 controls the head drive circuit 90 so as to print the deviation detection pattern A every 104 clocks.

The line sensor 25 reads the deviation detection patterns A printed on the recording paper P by the recording head 18 successively and outputs them as image data.

The CPU 40 stores image data outputted from the line sensor 25 in the RAM 44 temporarily and specifies position information ($a_k$, $b_k$), ($a_{k+1}$, $b_{k+1}$) of print start positions of adjacent deviation detection patterns $A_k$, $A_{k+1}$ based on the stored image data.

As indicated in FIG. 7, coordinate information of a case where a position indicated by a point O in the Figure is home position is used as position information.

The CPU 40 derives an interval $T_k$ of a print start position according to an equation (1) based on specified position information.

$$T_k=\sqrt{(a_{k+1}-a_k)^2+(b_{k+1}-b_k)^2} \tag{1}$$

When the deviation detection pattern A is printed every 104 dots at a resolution of 1200 dpi, the design value S of the interval between the adjacent deviation detection patterns A is expressed in an equation (2).

$$S = 104\times\frac{25.4}{1200} = 2.201 \tag{2}$$

Thus, a deviation amount $Z_k$ is expressed by a following equation (3) using an interval $T_k$ of the printed deviation detection patterns A and the design value S.

$$Z_k=T_k-S \tag{3}$$

A correction time $Q_k$ may be derived by a following equation (4) based on the deviation amount $Z_k$ and paper conveyance velocity V (according to the example indicated in Table 2, it is assumed that the drive frequency of the head is 24 kHz and the paper conveyance velocity is 508 mm/sec).

$$Q_k = \frac{Z_k/104}{V} \tag{4}$$

Following Table 2 shows the deviation amount Z of each step derived using the above equations (1) to (4), the deviation amount per dot of each step, a correction amount Q and a table value q set on the correction table.

The deviation amount per dot may be obtained by dividing the deviation amount Z by the quantity of clocks (104) contained in a step. If the deviation amount Z is a minus value, the print clock needs to be corrected by an amount of an absolute value of the deviation amount Z in a plus direction. If the deviation amount Z is a plus value, the print clock needs to be corrected by an amount of an absolute value of the deviation amount Z in a minus direction. Thus, Table 2 shows values obtained by multiplying the deviation amount per dot with −1.

The table value q to be set on the correction table actually is set step by step according to the resolution of the correction processing section 74. Thus, the resolution of the correction processing section 74 is a minimum resolution of the reference clock supply section 76.

Table 2 indicates values of a case of correcting the print clock in the unit of 25 nsec as the table value q with the operating clock supplied from the reference clock supply section 76 as 40 MHz and the resolution of the correction processing section 74 as 25 nsec.

TABLE 2

| Relation between deviation amount, correction time and table value of each step | | | | |
|---|---|---|---|---|
| Step No. | Deviation amount Z (μm) | Deviation amount per dot (mm/dot) | Correction amount Q (n sec) | Actual correction value q (n sec) |
| 0 | −3.10 | 0.0000298 | 59 | 50 |
| 1 | −3.10 | 0.0000298 | 59 | 50 |
| 2 | −3.20 | 0.0000308 | 61 | 50 |
| 3 | −3.20 | 0.0000308 | 61 | 50 |
| 4 | −3.30 | 0.0000317 | 62 | 50 |
| 5 | −3.40 | 0.0000327 | 64 | 75 |
| 6 | −3.45 | 0.0000332 | 65 | 75 |
| 7 | −3.50 | 0.0000337 | 66 | 75 |
| 8 | −3.40 | 0.0000327 | 64 | 75 |
| 9 | −3.25 | 0.0000313 | 62 | 50 |
| 10 | −3.10 | 0.0000298 | 59 | 50 |
| 11 | −2.90 | 0.0000279 | 55 | 50 |
| 12 | −2.63 | 0.0000253 | 50 | 50 |
| 13 | −2.35 | 0.0000226 | 45 | 50 |
| 14 | −2.01 | 0.0000193 | 38 | 50 |
| 15 | −1.61 | 0.0000155 | 31 | 25 |
| 16 | −1.16 | 0.0000112 | 22 | 25 |
| 17 | −0.67 | 0.0000064 | 13 | 25 |
| 18 | −0.14 | 0.0000014 | 3 | 0 |
| 19 | 0.41 | −0.0000039 | −8 | 0 |
| ... | ... | ... | ... | ... |
| 49 | ... | ... | ... | ... |

The deviation detection pattern A may be a dot as indicated in FIG. 7 from the viewpoint of correction of the print clock. However, if there is an omission of reading of the line sensor 25, no accurate correction table may be obtained. Thus, actually, the deviation detection pattern may be composed of plural dots considering the reading accuracy of the line sensor. In case where the deviation detection pattern A is composed of plural dots, the omission of reading may be prevented by the plural dot structure even if the reading accuracy of the line sensor is low. As a result, an accurate correction table may be obtained.

Figure 8:
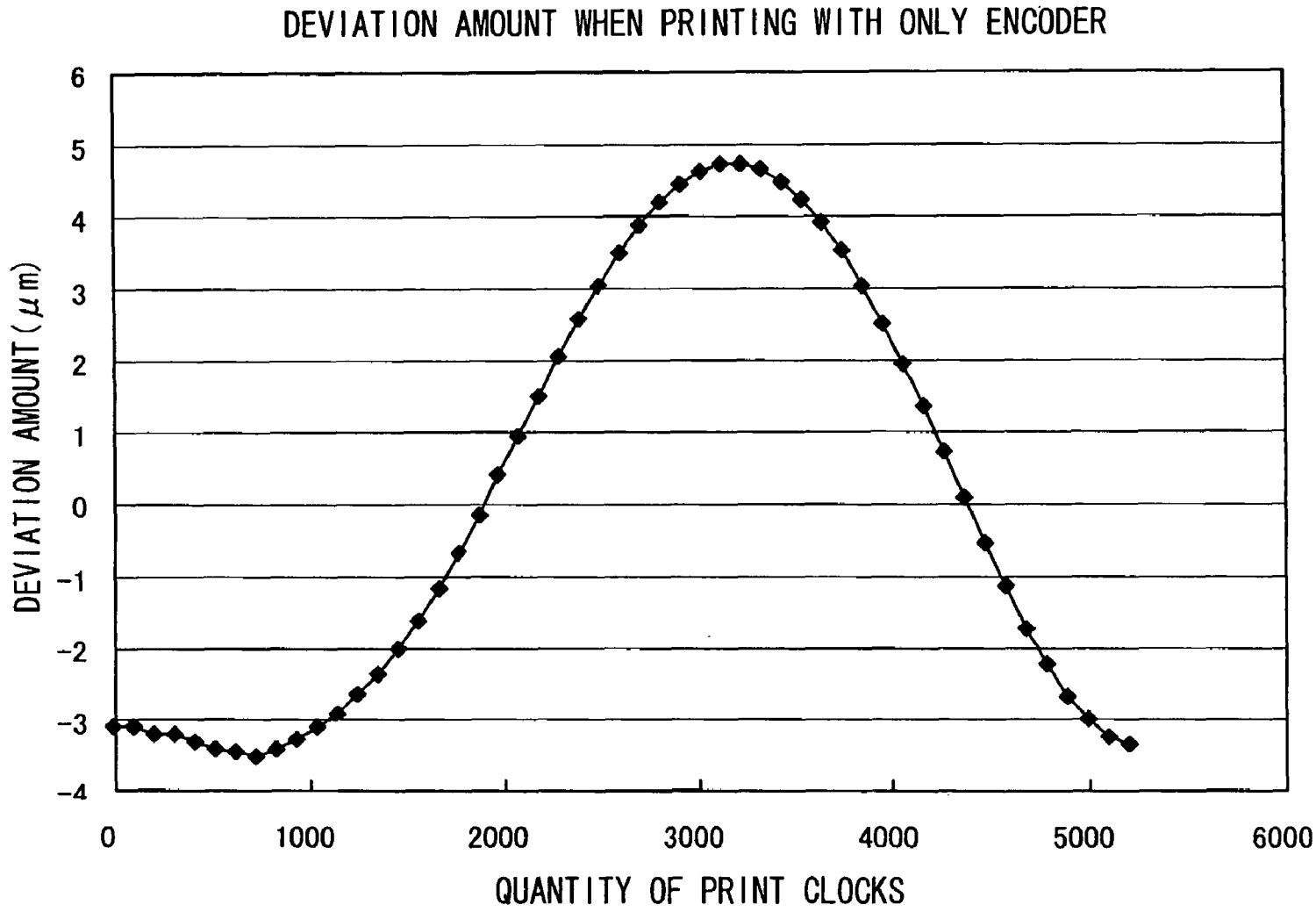
FIG. 8 is a graph showing an example of the deviation amount derived from a deviation amount detection pattern.

FIG. 8 shows the deviation amount Z when the drive roll 11 is rotated by a single turn from the reference position detection timing. As indicated in FIG. 8, the deviation amount fluctuations while the drive roll 11 makes a single turn. This fluctuation is estimated to result from eccentricity of the rotation shaft of the drive roll 11 or the encoder film 64 attached to the rotation shaft or an error in the arrangement interval of the print timing marks 62.

As shown in FIG. 8, the average of the deviation amount Z of a single turn of the drive roll 11 never turns to 0. This is because it that the deviation amount Z at a detection timing of the reference position of the drive roll 11 is not 0.

Figure 9:
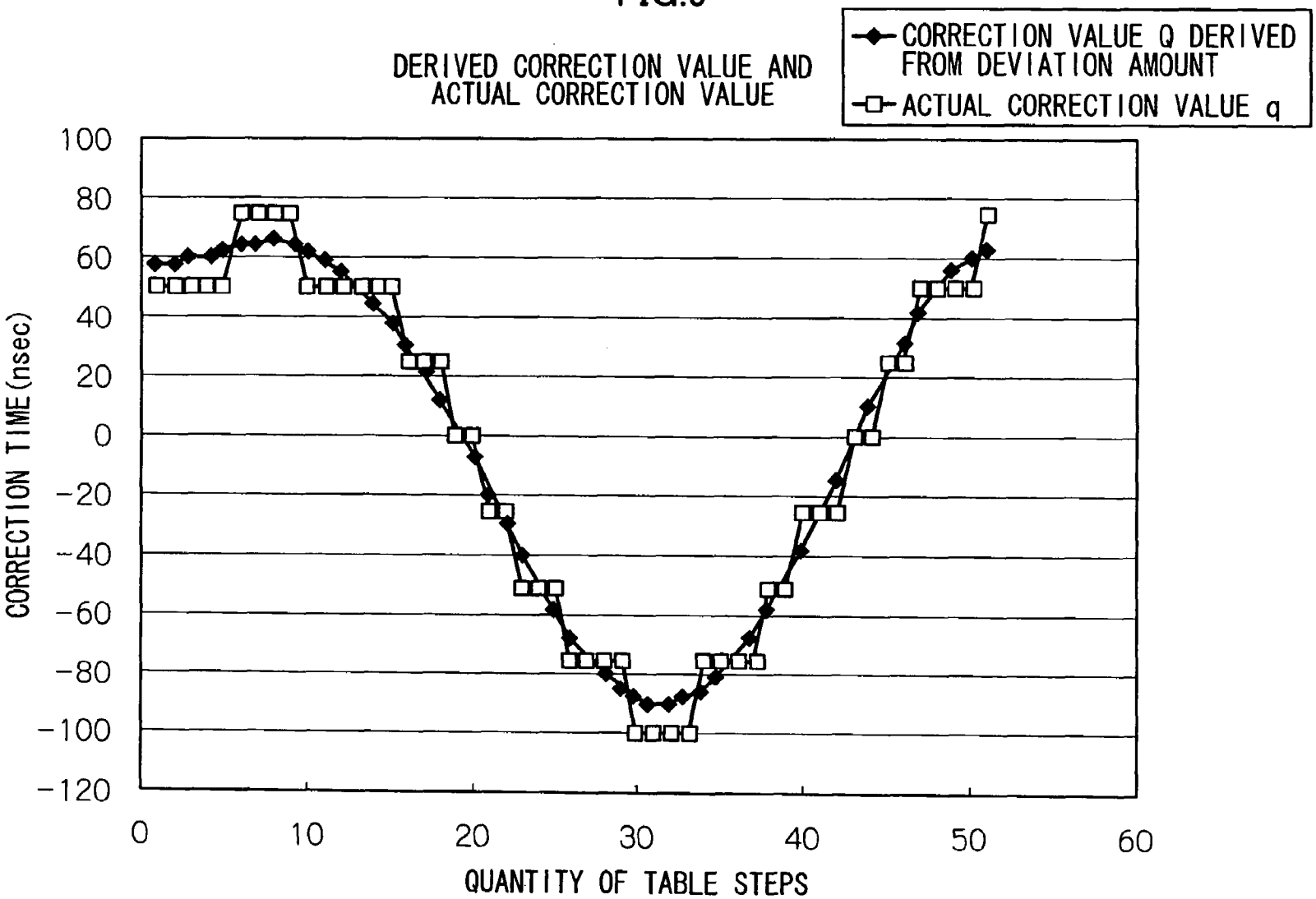
FIG. 9 is a graph showing a correction value derived based on the deviation amount shown in FIG. 8 and an actual correction value.

FIG. 9 indicates the correction value Q and table value q derived based on the deviation amount shown in FIG. 8. As indicated in FIG. 9, the table value q is obtained by approximating the derived correction value Q to values of every 25 nsec according to the resolution of the correction processing section 74. The curve of the table value q is almost inverse to the curve of the deviation amount Z.

Figure 10:
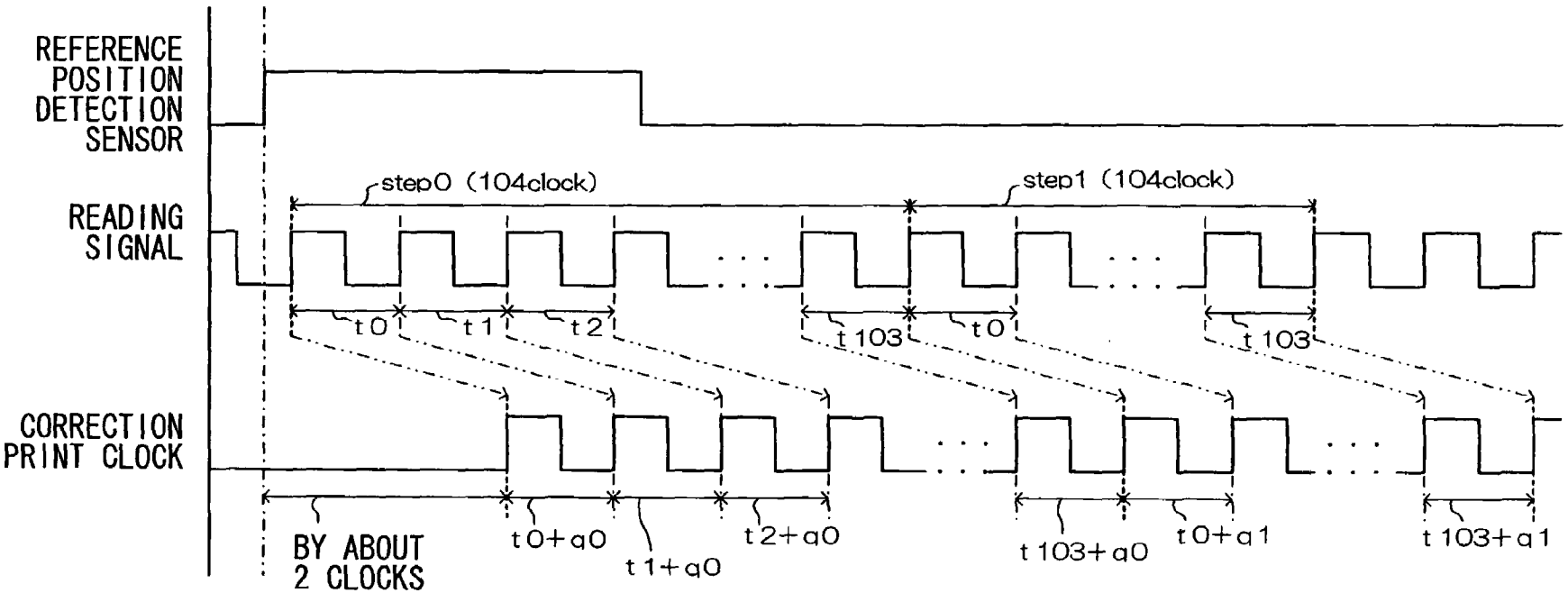
FIG. 10 is a timing chart showing a reference position detection signal, reading signal and correction print clock outputted form the correction print clock generating section.

As shown in FIG. 10, the correction processing section 74 corrects the pulse width of an inputted reading signal only by the correction value q stored in the correction table storage section 72. At this time, as the pulse width of a clock contained in the same step, the same correction value q is used.

FIG. 10 indicates the correction value q of step 0 as q0 and the correction value q of step 1 as q1. Because referring to Table 1, the correction value q of step 0 is 50 nsec, an amount for 104 clocks contained in the step 0 is outputted as the correction print clock by adding 50 nsec to its pulse width.

In the example shown in FIG. 10, the correction processing section 74 outputs the correction print clock by delaying it by an amount for two clocks from the reading signal.

Although in the first exemplary embodiment, an example that the delay period by the correction processing section 74 is an amount for about two clocks in terms of the print clock has been described, the delay period may be set appropriately considering fluctuations in the maximum velocity.

In the first exemplary embodiment, an example that the interval T is derived using the equation (1) has been described. In the first exemplary embodiment, the deviation detection pattern on the recording paper P kept adhered electrostatically onto the conveyance belt 14 is read by the line sensor 25 disposed in the downstream with respect to an ejection position of ink droplet of the recording head 18 and therefore, coordinates in the nozzle arrangement direction may be regarded as equal. Then, the interval may be derived using a following equation (5).

$$T_k = a_{k+1} - a_k \tag{5}$$

(First Modification)

In the first exemplary embodiment, the example of starting printing of the deviation detection pattern A based on a timing when the reference position is detected after a paper front end is detected in the creation processing of the correction table has been described. Hereinafter, as a first modification, an example of starting printing of the deviation detection pattern A based on a timing when the paper front end is detected will be described.

Figure 11:
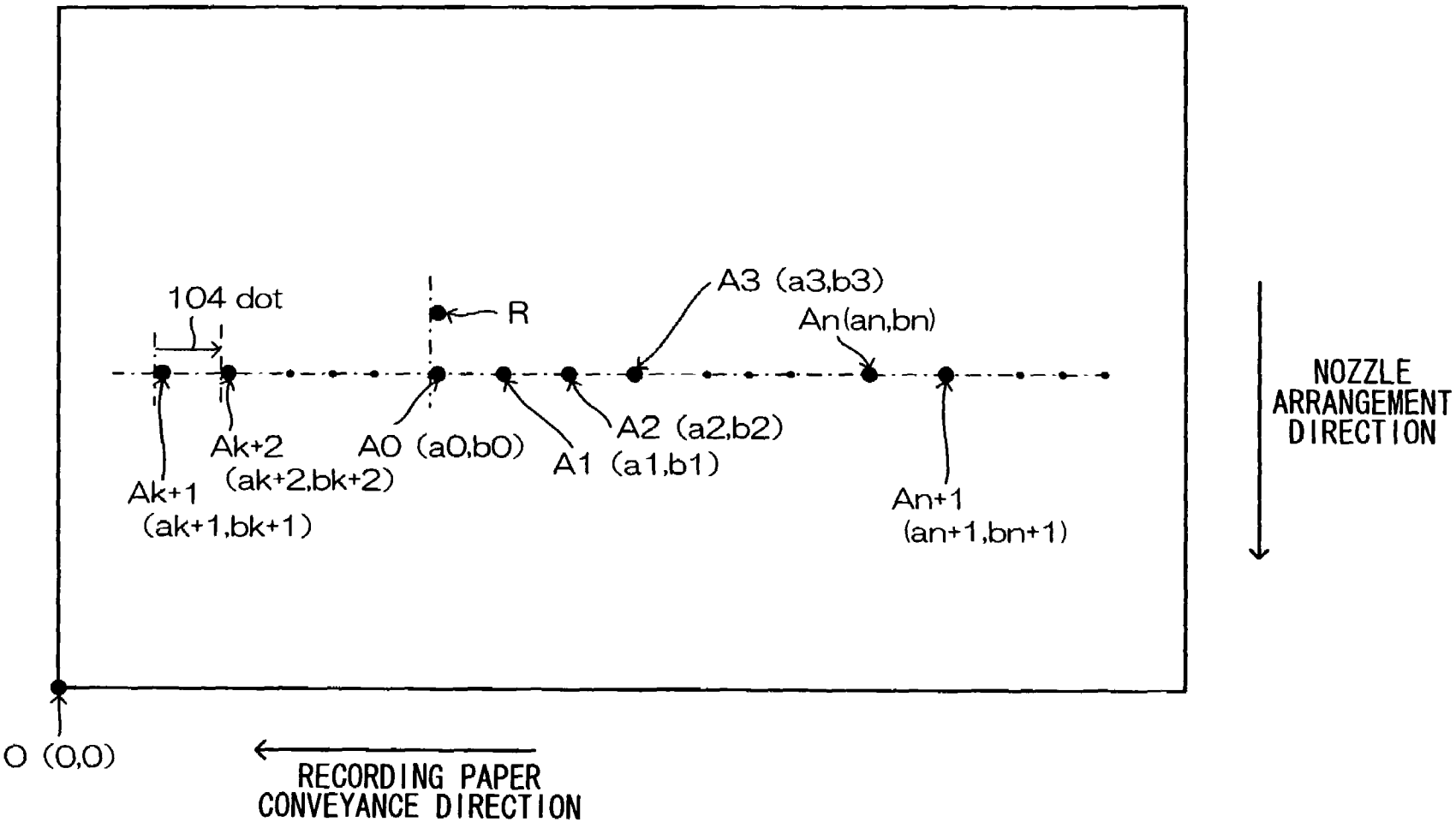
FIG. 11 is an explanatory diagram of other deviation detection pattern and an derivation method of the correction amount based on the deviation detection pattern.

The deviation detection pattern A printed at the head of the recording paper P is not limited to $A_0$ as shown in FIG. 11. Thus, in the first modification, the detection mark R is printed at a timing when the reference position is detected. As shown in FIG. 11, the detection mark R is printed in an area different from the print area from the deviation detection pattern A.

The CPU 40 specifies the printed deviation detection pattern A whose recording paper conveyance direction position is the same as the detection mark R as $A_0$ and creates a correction table.

In this case, n+1 (51 in the example indicated in Table 1 and Table 2) or more deviation detection patterns A may be printed or the deviation detection patterns A in an amount larger than the number corresponding to a single turn may be printed.

(Second Modification)

If the deviation detection patterns A in an amount larger than the number corresponding to a single turn are printed, plural correction values Q are obtained in each step. Therefore, an actual correction value q may be derived based on the plural correction values Q.

Figure 12:
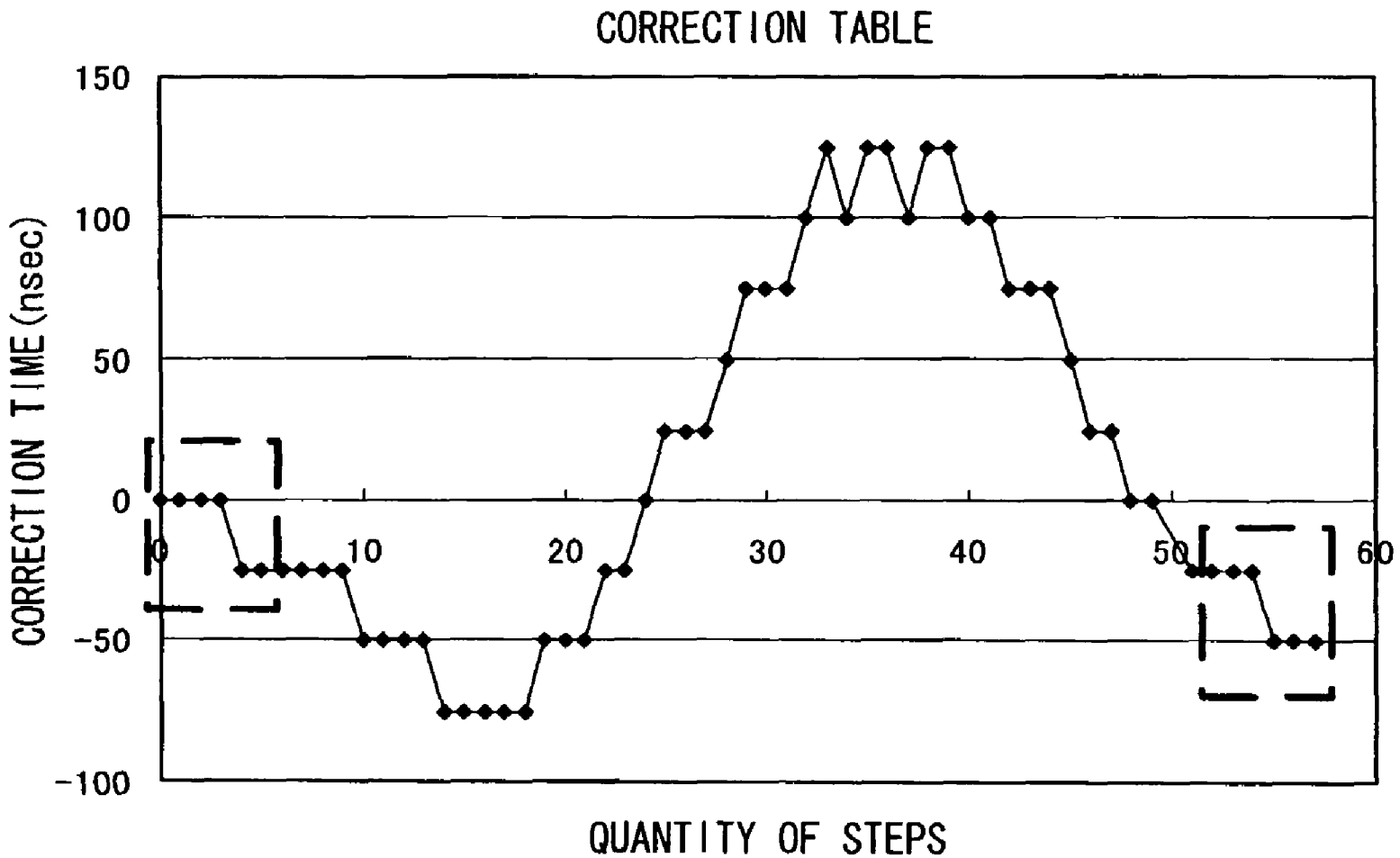
FIG. 12 is a graph showing an example of correction value deviation between the head and end of the correction table.

At cycle joint portion indicated with a dotted line frame in FIG. 12, there is a tendency that a large difference exists. To reduce this difference to smoothen the joint, averaging procedure may be performed.

At this time, the plural correction values Q may be averaged simply as they are or may be averaged after weighting.

(Third Modification)

In the first exemplary embodiment, the example that the design value is used as the conveyance velocity V of the recording paper P has been described. An actually measured value of the conveyance velocity may be used instead of the design value.

In this case, a mechanism for measuring the conveyance velocity is needed.

For example, a Doppler measuring device capable of measuring the surface velocity of the conveyance belt 14 may be used.

The Doppler measuring device calculates the velocity of an object by measuring reflection waves of electromagnetic waves using a fact that the frequencies of the reflection waves are changed by Doppler effect when the object is moving in the advance direction of the electromagnetic waves.

Although this Doppler measuring device may be provided on the image forming apparatus 10, it only needs to be set when the correction table is created, for example, at the time of shipment from plant, and it does not need to be always equipped on the image forming apparatus 10.

(Fourth Modification)

In the first modification, the example of creating the correction table by reading the detection pattern A by the line sensor 25 provided within the image forming apparatus 10 has been described. Instead of this, may be configured so as to create the correction table by scanning a recording paper P ejected to the exit tray 22 after the detection pattern A is printed, by an external device.

In this case, the external device obtains derivation of the correction value based on the image data obtained by scanning and create the correction table.

When correction table data indicating the created correction table is inputted to the image forming apparatus 10, and stored in the correction table storage section 72 by the CPU 40.

Because there sometimes occurs a difference in angle of an original document between print time and scanning time, the above-mentioned equation (1) may be used to derive the interval T of the adjacent deviation detection patterns A.

Second Exemplary Embodiment

In the first exemplary embodiment, the image forming apparatus 10 which executes the print directly on the recording paper P has been described. As the second exemplary embodiment, an image forming apparatus 200 in which an image is formed on an intermediate transfer medium and then, the image formed on the intermediate transfer medium is transferred to the recording paper P will be described.

Figure 13:
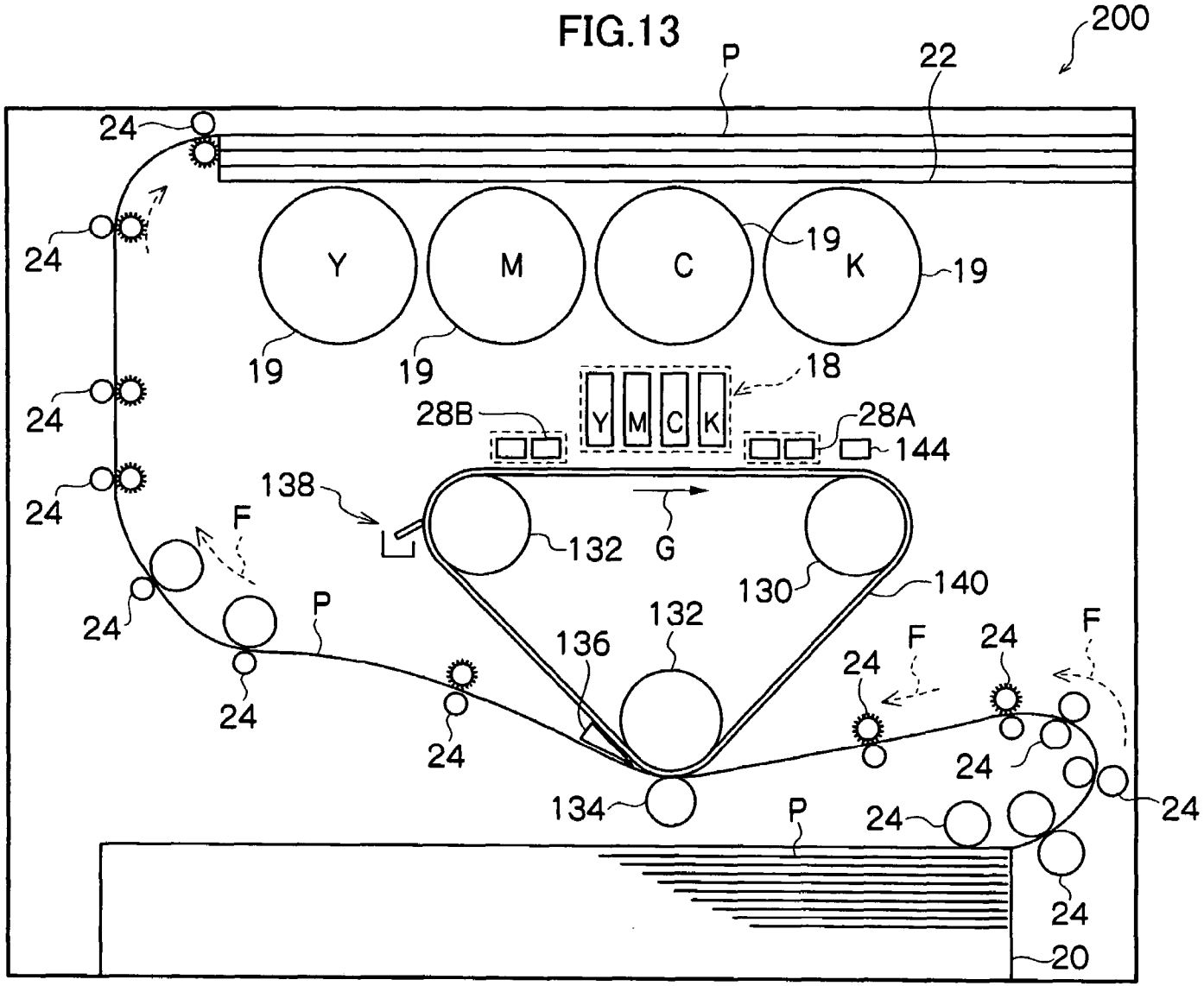
FIG. 13 is a schematic diagram showing the structure of an image forming apparatus according to a second exemplary embodiment.

FIG. 13 shows the configuration of the image forming apparatus 200 of the second exemplary embodiment. In FIG. 13, like reference numerals are attached to the same components as the first exemplary embodiment and description thereof are omitted.

As shown in FIG. 13, the image forming apparatus 200 of the second exemplary embodiment ejects ink droplets to the intermediate transfer medium 140 by the recording head 18. The intermediate transfer belt 140 is stretched around a drive roll 130 and a driven roll 132 and rotates in a direction of G.

The intermediate transfer belt 140 is flattened by the drive roll 130 and one of the driven rolls 132 at a position opposing the recording head 18.

A transfer roll 134 and a separation pawl 136 are disposed in a rotation direction of the intermediate transfer belt 140 in the downstream with respect to an ink droplet ejection position of the recording head 18. The transfer roll 134 is pressed against the driven roll 132 via the intermediate transfer belt 140 and transfers an ink image from the intermediate transfer belt 140 to the recording paper P when the recording paper P is conveyed while pressed against the intermediate transfer belt 140. The separation pawl 136 separates the recording paper P from the intermediate transfer belt 140.

As shown in FIG. 13, a cleaning blade 138 is provided at a position opposing the driven roll 132 in the downstream in the belt rotation direction with respect to the separation pawl 136 and in the upstream in the belt rotation direction of the recording head 18. The cleaning blade 138 wipes out ink left on the intermediate transfer belt 140 without being transferred to the recording paper P.

In the image forming apparatus 200 having such a structure, the deviation detection pattern A is formed on the intermediate transfer belt 140 in order to create the correction table.

The deviation detection pattern A formed on the intermediate transfer belt 140 may be read by a line sensor 144 provided in the downstream with respect to the ink droplet ejection position and in the upstream with respect to the transfer position in the rotation direction of the intermediate transfer belt 140. In this case, transfer to the recording paper P is not needed.

In the meantime, the second modification may be modified like from the first modification to the fourth modification.

Although in each of the above mentioned exemplary embodiments, the example that the print timing mark 62 provided on the encoder film 64 attached to the rotation shaft of the drive roll 11 is read and used as the print clock has been described, the invention is not limited to this example.

Figure 14:
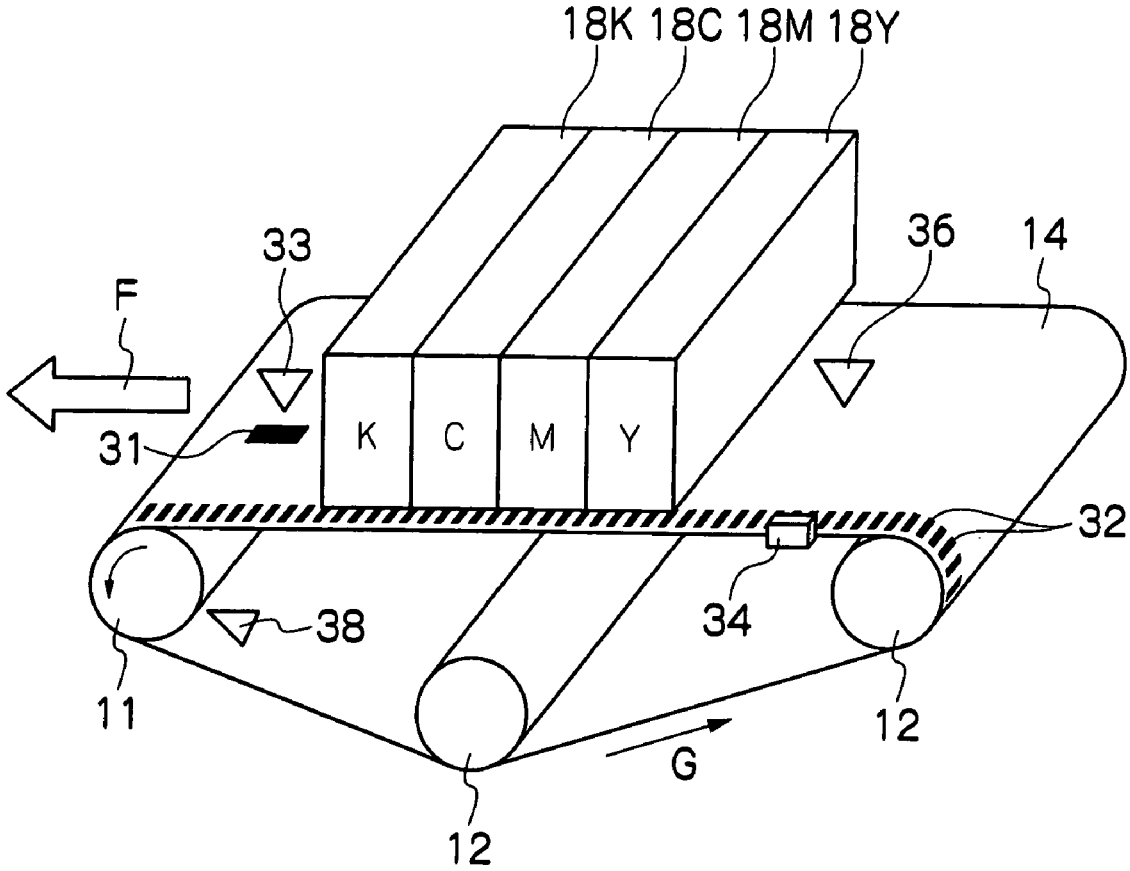
FIG. 14 is a schematic diagram showing the structure around the recording head according to other exemplary embodiment.

For example, the invention may be applied to an apparatus in which the print timing mark 32 is attached to the conveyance belt 14 as shown in FIG. 14. As shown in FIG. 14, the print timing mark 32 is attached at a location not hidden by the recording paper P on a face opposing the recording head array 18 of the conveyance belt 14 even in a condition in which the recording paper P is conveyed in an adhered state. The print timing marks 32 are attached at an equal interval in the conveyance direction along the entire circumference of the conveyance belt 14. The interval of the print timing mark 32 is an interval according to resolution in the conveyance direction of the image forming apparatus 10.

As shown in FIG. 14, the encoder sensor 34 capable of detecting the aforementioned timing mark 32 is disposed in the upstream side in the conveyance direction of the recording paper P with respect to the recording head array 18. Consequently, the print timing marks 32 are detected successively by the encoder sensor 34 with a rotation of the conveyance belt 14 by the drive roll 11.

A conveyance belt reference mark 31 is provided at a location on a face opposing the recording head array 18 of the conveyance belt 14. A conveyance belt reference mark detecting sensor 33 capable of reading the conveyance belt reference mark 31 is disposed in the downstream side in the conveyance direction of the recording paper P of the recording head array 18.

In the conveyance belt reference mark detecting sensor 33, the conveyance belt reference mark 31 is detected every time when the conveyance belt 14 makes a single turn with a rotation of the conveyance belt 14 by the drive roll 11.

Although FIG. 14 indicates an apparatus which ejects ink droplets directly to the recording paper P, in description of the image forming apparatus 200 mentioned in the second exemplary embodiment, the conveyance belt 14 may replaced with the intermediate transfer belt 140.

Although this exemplary embodiment has been described under a condition in which the correction table is created at the time of shipment from plant, the invention is not limited to this example, but the correction table may be updated periodically. As the update timing of this correction table, maintenance completion time, every time when a predetermined quantity (for example, 10,000 pieces) is recorded, an initialization time and the like may be mentioned.

Although in each of the above described exemplary embodiments, the example that the deviation detection pattern A is constituted of 1-dot ink droplet has been described, the invention is not limited to this but the deviation detection pattern may be constituted of plural dots. Further, it may be constituted in a circular form or linear form of plural dots.

Although in the above-described exemplary embodiment, the example that the deviation detection patterns are formed every 104 dots and the correction information is set in the unit of 104 dots has been described, the invention is not limited to this. If the cyclic fluctuation is large, correction accuracy may be raised by setting a range smaller than 104 dots to increase the quantity of correction steps. If the cyclic fluctuation is small, a range larger than 104 dots is set to reduce the quantity of the correction steps thereby reducing the correction processing time and memory capacity.

The structure (see FIGS. 1-5) of the image forming apparatus 10 of this exemplary embodiment is just an example and the invention may be modified appropriately within a range not departing from the spirit of the invention.

The processing flow of the exemplary embodiment (see FIG. 10) is just an example also and needless to say, this may be modified appropriately within a range not departing from the spirit of the invention.

Although in this exemplary embodiment, the invention has been described by taking an ink jet image forming apparatus as an example, the invention may be applied to not only the ink jet image forming apparatus but generally the droplet ejection apparatus for a variety of industrial purposes, for example, production of a color filter for the display which ejects colored ink onto polymer film or formation of en EL display panel which ejects organic EL solution onto a substrate.

The recording medium which is an object for image recording in the droplet ejection apparatus of the invention widely includes objects to which the droplet ejecting head ejects ink droplets. Thus, although it is needless to say that the recording medium includes the recording paper and OHP, it includes other recording mediums, for example, polymer film.

The moving unit in the ink droplet ejection apparatus of the invention includes widely any member which conveys the recording medium, for example, the conveyance drum as well as the conveyance belt of the above-described exemplary embodiment.

The foregoing description of the embodiments of the present invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to are suited to the particular use contemplated. It is intended that the scope of the invention be defined by the following claims and their equivalents.

What is claimed is:

1. A droplet ejecting apparatus comprising:

a droplet ejecting head for ejecting droplets onto a recording medium;

a moving unit for moving the recording medium relative to the droplet ejecting head;

an output unit for outputting a pulse signal which is generated along with moving of the moving unit and which has a pulse width comprising a cyclic fluctuation;

a reference position detection unit for detecting a reference position in the cyclic fluctuation;

a pattern memory for storing image information of a detection pattern comprising a plurality of unit patterns which are set in advance;

a reading unit for reading an image formed on the recording medium;

a detection pattern output unit that drives the droplet ejecting head based on the pulse signal outputted from the output unit and the image information of the detection pattern stored in the pattern memory when a detection pattern output instruction is present;

a correction information generating unit that makes the reading unit read an image on the recording medium on which the detection pattern image is formed by the detection pattern output unit, derives a distance between the unit patterns adjacent each other based on the image read by the reading unit, compares the distance with a distance according to a conveyance velocity of the recording medium by the moving unit, and generates correction information so as to enlarge the pulse width when the derived distance is shorter than the distance according to the conveyance velocity, and to reduce the pulse width when the derived distance is longer than the distance according to the conveyance velocity;

a memory that stores the correction information generated by the correction information generating unit;

a correction unit for correcting the pulse width of the pulse signal outputted from the output unit based on a detection timing of the reference position by the reference position detection unit and the correction information stored in the memory; and a head controller for forming an image according to image information on the recording medium by controlling the droplet ejecting timing of the droplet ejection head using the pulse signal corrected by the correction unit.

2. The droplet ejecting apparatus of claim 1, wherein the memory stores the correction information for each unit of a predetermined number of continuous pulses.

3. The droplet ejecting apparatus of claim 2, wherein:

the image information of the detection pattern comprises the plurality of the unit patterns each comprising the predetermined number of continuous pulses; and the correction information generating unit generates the correction information with an identical pulse width for every unit of the predetermined number of continuous pulses.

4. The droplet ejecting apparatus of claim 1, wherein the pattern memory stores image data of the unit pattern, a number of the unit patterns, and a distance between the unit patterns as the image information of the detection pattern.

5. The droplet ejecting apparatus of claim 1, wherein the detection pattern comprises the unit patterns of a number obtained by dividing an amount of a single cycle of the cyclic fluctuation by a unit of the predetermined number of continuous pulses.

6. The droplet ejecting apparatus of claim 1, wherein the detection pattern comprises a larger number of the unit patterns than a number corresponding to an amount of a single cycle of the cyclic fluctuation.

7. The droplet ejecting apparatus of claim 6, further comprising a recording medium front end detection unit that is provided downstream in the recording medium moving direction from the droplet ejecting head and detects the front end of the recording medium, wherein the detection pattern output unit starts image formation of the detection pattern when the recording medium front end detection unit detects the front end of the recording medium, and drives the droplet ejecting head so as to form an image of a reference signal pattern indicating that the reference position has been detected at a timing when the reference position is detected by the reference position detection unit during execution of the image formation of the detection pattern.

8. The droplet ejecting apparatus of claim 6, wherein the correction information generating unit generates the correction information by averaging the correction information of images of a plurality of the corresponding unit patterns of different cycles.

9. The droplet ejecting apparatus of claim 1, wherein the detection pattern output unit drives the droplet ejecting head so as to start the image formation of the detection pattern at the detection timing of the reference position by the reference position detection unit.

10. The droplet ejecting apparatus of claim 1, wherein the detection pattern output unit drives the droplet ejecting head so as to form an image of a reference signal pattern indicating that the reference position has been detected at a timing when the reference position is detected by the reference position detection unit during the execution of image formation of the detection pattern.

11. The droplet ejecting apparatus of claim 1, wherein the image of the unit pattern comprises a single pixel.

12. The droplet ejecting apparatus of claim 1, wherein the image of the unit pattern comprises a plurality of pixels.

13. The droplet ejecting apparatus of claim 1, further comprising an updating unit for updating the correction information stored in the memory.

14. The droplet ejecting apparatus of claim 1, wherein the recording medium is an intermediate transfer medium.

15. The droplet ejecting apparatus of claim 1, wherein:

the moving unit comprises a conveyance belt that is stretched around a drive roll and a driven roll which are rotated so as to convey the recording medium; and the reference position is provided on the peripheral face of the drive roll.

16. The droplet ejecting apparatus of claim 1, wherein:

the moving unit comprises a conveyance belt for moving the recording medium;

the reference position is provided on the conveyance belt; and the reference position detecting unit is provided at the downstream side in the recording medium moving direction of the droplet ejecting head so as to detect the reference position.

17. The droplet ejecting apparatus of claim 1, wherein the reading unit comprises a line sensor provided at the downstream side in the recording medium moving direction of the droplet ejecting head.

18. The droplet ejecting apparatus of claim 1, wherein the conveyance velocity is a design value.

19. The droplet ejecting apparatus of claim 1, wherein:

the moving unit comprises a conveyance belt for moving the recording medium; and the conveyance velocity is a surface velocity of the conveyance belt.

20. A droplet ejecting apparatus comprising:

an image forming unit comprising:

a droplet ejecting head for ejecting droplets onto a recording medium;

a moving unit for moving the recording medium relative to the droplet ejecting head;

an output unit for outputting a pulse signal which is generated along with moving of the moving unit and which has a pulse width comprising a cyclic fluctuation;

a reference position detection unit for detecting a reference position in the cyclic fluctuation;

a pattern memory for storing detection pattern image information comprising a plurality of unit patterns which are set in advance;

a detection pattern output unit that drives the droplet ejecting head based on the pulse signal outputted from the output unit and the image information of the detection pattern stored in the pattern memory when a detection pattern output instruction is present;

a memory that stores correction information for correcting the pulse signal outputted by the output unit;

a correction unit for correcting the pulse width of the pulse signal outputted from the output unit based on a detection timing of the reference position by the reference position detection unit and the correction information stored in the memory; and a head controller for forming an image according to image information on the recording medium by controlling the droplet ejecting timing of the droplet ejection head using the pulse signal corrected by the correction unit, and an information processing unit comprising:

a reading unit for reading an image formed on the recording medium;

a correction information generating unit that, when the image read by the reading unit is an image on the recording medium which the detection pattern output unit has formed, derives a distance between the unit patterns adjacent each other based on the image read by the reading unit, compares the distance with a distance according to the conveyance velocity of the recording medium by the moving unit, and generates correction information so as to enlarge the pulse width when the derived distance is shorter than the distance according to the conveyance velocity, and to reduce the pulse width when the derived distance is longer than the distance according to the conveyance velocity; and a transmitting unit for transmitting the correction information generated by the correction information generating unit to the image forming apparatus.

* * * * *